US010444688B2

(12) United States Patent
Kawai

(10) Patent No.: US 10,444,688 B2
(45) Date of Patent: Oct. 15, 2019

(54) EDITING APPARATUS, NON-TRANSITORY STORAGE MEDIUM, AND PRINTING APPARATUS

(71) Applicant: BROTHER KOGYO KABUSHIKI KAISHA, Nagoya-shi, Aichi-ken (JP)

(72) Inventor: Junya Kawai, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/223,458

(22) Filed: Dec. 18, 2018

(65) Prior Publication Data

US 2019/0235432 A1 Aug. 1, 2019

(30) Foreign Application Priority Data

Jan. 31, 2018 (JP) ..... 2018-015690
Nov. 7, 2018 (JP) ..... 2018-209949

(51) Int. Cl.
*G03G 15/00* (2006.01)

(52) U.S. Cl.
CPC ..... *G03G 15/5029* (2013.01); *G03G 15/5016* (2013.01)

(58) Field of Classification Search
CPC ..... G03G 15/5029; G03G 15/5016
See application file for complete search history.

(56) References Cited

U.S. PATENT DOCUMENTS

2006/0263132 A1* 11/2006 Yamamoto ..... B41J 3/4075 400/62
2009/0231607 A1* 9/2009 Kurashina ..... B41J 3/4075 358/1.11
2015/0331588 A1* 11/2015 Ishida ..... G06F 3/04812 715/765

FOREIGN PATENT DOCUMENTS

JP H10-250130 A 9/1998
JP 2009-217662 A 9/2009
JP 2013-095106 A 5/2013
JP 2016-199000 A 12/2016

* cited by examiner

*Primary Examiner* — Ibrahim Siddo
(74) *Attorney, Agent, or Firm* — Scully, Scott, Murphy & Presser, PC

(57) ABSTRACT

An editing apparatus, including a display and a controller configured to: obtain a size of a printing medium; obtain a layout, with respect to the printing medium, of a print object to be printed on the printing medium; obtain a length of a circumference of an adherend to which the printing medium is to be stuck; and execute a display control process of displaying, on the display, the layout such that an overlap portion and a non-overlap portion of the printing medium are distinguishable, the overlap portion being a portion of the printing medium which is covered, when the printing medium is stuck along the circumference of the adherend in order from one end to the other end of the printing medium in its specific direction, by a portion of the printing medium including the other end, the non-overlap portion being a portion of the printing medium except the overlap portion.

13 Claims, 9 Drawing Sheets

FIG.4

52

| TAPE TYPE | LENGTH OF PRINTING REGION (mm) | LENGTH OF LAMINATE REGION (mm) | DIAMETER OF ADHEREND (mm) | CIRCUMFERENTIAL LENGTH OF ADHEREND (mm) | OVERLAP AMOUNT (mm) |
|---|---|---|---|---|---|
| LAMINATE TRANSPARENT LAMINATE RECEPTOR TRANSPARENT RECEPTPOR | 25.4 | 0 | 10 | 31.4 | −6.0 |
| | 25.4 | 0 | 9 | 28.3 | −2.9 |
| | 25.4 | 0 | 8 | 25.1 | 0.3 |
| | 25.4 | 0 | 7 | 22.0 | 3.4 |
| | 25.4 | 0 | 6 | 18.8 | 6.6 |
| | 25.4 | 0 | 5 | 15.7 | 9.7 |
| | 25.4 | 0 | 4 | 12.6 | 11.8 |
| SELF LAMINATE TRANSPARENT SELF LAMINATE | 25.4 | 25.4 | 10 | 31.4 | −6.0 |
| | 25.4 | 25.4 | 9 | 28.3 | −2.9 |
| | 25.4 | 25.4 | 8 | 25.1 | 0.3 |
| | 25.4 | 25.4 | 7 | 22.0 | 3.4 |
| | 25.4 | 25.4 | 6 | 18.8 | 6.6 |
| | 25.4 | 25.4 | 5 | 15.7 | 9.7 |
| | 25.4 | 25.4 | 4 | 12.6 | 11.8 |
| ⋮ | ⋮ | ⋮ | ⋮ | ⋮ | ⋮ |

EDITING APPARATUS, NON-TRANSITORY STORAGE MEDIUM, AND PRINTING APPARATUS

CROSS REFERENCE TO RELATED APPLICATION

The present application claims priority from Japanese Patent Application No. 2018-015690, which was filed on Jan. 31, 2018, the disclosure of which is herein incorporated by reference in its entirety.

BACKGROUND

Technical Field

The following disclosure relates to an editing apparatus, a non-transitory storage medium storing a program readable by a controller of the editing apparatus, and a printing apparatus.

Description of Related Art

An apparatus for creating a label to be stuck to a cable is known. The known apparatus is configured to display, on a priority basis, a specific candidate among a plurality of selection candidates in accordance with an editing condition.

SUMMARY

For example, in the case where a user sticks the label edited by the known apparatus to the cable such that the label is wrapped around the cable, a situation may occur in which a part of a print object on the label is invisible. In such a situation, the user retries a layout of the print object for enabling an entirety of the print object to be visible in a state in which the label is wrapped around the cable. This is, however, troublesome for the user.

Accordingly, an aspect of the disclosure is directed to an editing apparatus, a non-transitory storage medium, and a printing apparatus capable of ensuring improved user convenience in laying out a print object on a label which is used by being stuck to a cable or the like.

In a first aspect of the disclosure, an editing apparatus includes: a display; and a controller configured to control the display, wherein the controller is configured to: obtain a size of a printing medium; obtain a layout, with respect to the printing medium, of a print object to be printed on the printing medium; obtain a length of a circumference of an adherend to which the printing medium is to be stuck; and execute a display control process of displaying, on the display, the layout of the print object with respect to the printing medium such that an overlap portion of the printing medium and a non-overlap portion of the printing medium are distinguishable from each other, the overlap portion being a portion of the printing medium which is covered, when the printing medium is stuck along the circumference of the adherend in order from one end to the other end of the printing medium in a specific direction thereof, by a portion of the printing medium including the other end, the non-overlap portion being a portion of the printing medium except the overlap portion.

In a second aspect of the disclosure, a non-transitory storage medium stores a program readable by the controller of the editing apparatus described above, wherein the program, when executed by the controller, causes the controller to: obtain a size of a printing medium; obtain a layout, with respect to the printing medium, of a print object to be printed on the printing medium; obtain a length of a circumference of an adherend to which the printing medium is to be stuck; and execute a display control process of displaying, on the display, the layout of the print object with respect to the printing medium such that an overlap portion of the printing medium and a non-overlap portion of the printing medium are distinguishable from each other, the overlap portion is a portion of the printing medium which is covered, when the printing medium is stuck along the circumference of the adherend in order from one end to the other end of the printing medium in a specific direction thereof, by a portion of the printing medium including the other end, the non-overlap portion being a portion of the printing medium except the overlap portion.

In a third aspect of the disclosure, a printing apparatus includes: a display: a conveyor configured to convey a printing medium along a conveyance path; a printer configured to perform printing on the printing medium conveyed by the conveyor; and a controller configured to control the display, the conveyor, and the printer, wherein the controller is configured to: obtain a size of the printing medium; obtain a layout, with respect to the printing medium, of a print object to be printed on the printing medium; obtain a length of a circumference of an adherend to which the printing medium is to be stuck; execute a display control process of displaying, on the display, the layout of the print object with respect to the printing medium such that an overlap portion of the printing medium and a non-overlap portion of the printing medium are distinguishable from each other, the overlap portion being a portion of the printing medium which is covered, when the printing medium is stuck along the circumference of the adherend in order from one end to the other end of the printing medium in a specific direction thereof, by a portion of the printing medium including the other end, the non-overlap portion being a portion of the printing medium except the overlap portion; create print data for printing, on the printing medium, at least a part of the print object corresponding to the non-overlap portion; and cause the printer to perform printing on the printing medium based on the created print data.

Concerning the expression "displaying the layout of the print object with respect to the printing medium", displaying a part of the print object corresponding to a portion of the printing medium will be simply expressed as displaying the portion of the printing medium in the explanation below.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which:

FIG. 4 is a table for explaining a set value storage area;

DETAILED DESCRIPTION OF THE EMBODIMENT

Figure 1:
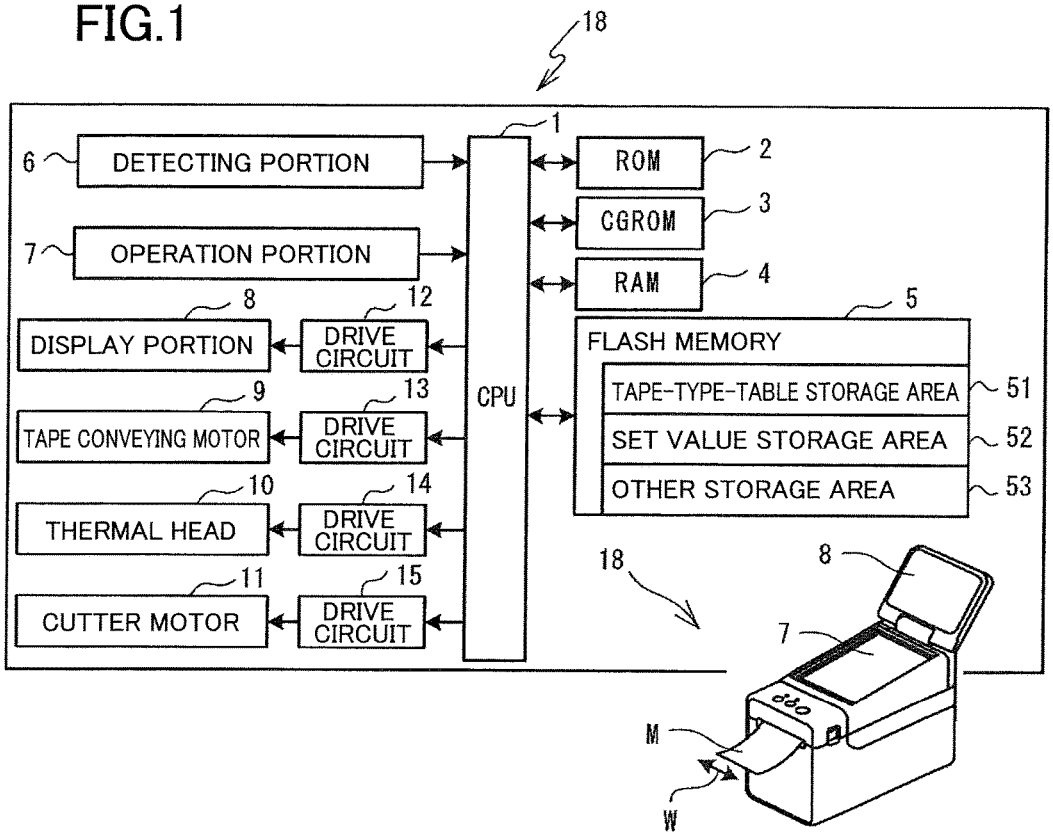
FIG. 1 is a block diagram illustrating an electric configuration of a printing apparatus according to one embodiment.

Referring to the drawings, one embodiment of the disclosure will be explained. In the embodiment, the unit of length is mm. In the following explanation, image data based on which an image is displayed will be simply referred to as an image where appropriate.

As shown in FIG. 1, a printing apparatus 18 (as one example of an editing apparatus or a printing apparatus) according to one embodiment is a small-sized label printer configured to print characters (such as letters, symbols, and numerals) on a tape M. The tape M which is a tape-shaped printing medium is a non-fixed length adhesive tape with release paper. The printing apparatus 18 is configured to edit and display a print image. The print image is an image indicating a layout of a print object with respect to the printing medium. The editing of the print image is a concept including creation of a new print image, a change of display contents, and a change of the layout of the print object. The printing apparatus 18 includes a CPU 1, a ROM 2, a CGROM 3, a RAM 4, and a flash memory 5. The ROM 2, the CGROM 3, the RAM 4, and the flash memory 5 are electrically connected to the CPU 1.

The ROM 2 stores various programs necessary for the control of the printing apparatus 18. The CPU 1 performs various calculations according to the programs. The CGROM 3 stores print dot pattern data for printing various characters. The print dot pattern data is classified according to format and size and stored in association with code data. Thus, the printing apparatus 18 is capable of identifying a size of the print object if the characters, the format, and the size are specified. The RAM 4 includes a plurality of storage areas such as a text memory and a print buffer. In the text memory, data of the print object is stored. In the print buffer, the print dot pattern data of the print object is stored. In other storage area, various sorts of calculation data are stored.

Figure 3A:
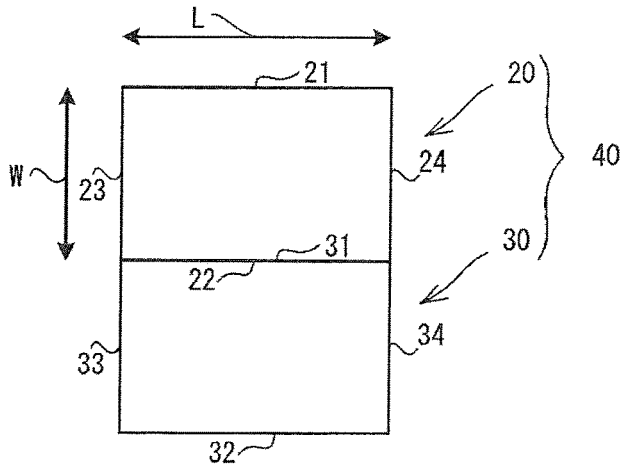
FIG. 3A is a view of a printing medium.

The flash memory 5 includes a tape-type-table storage area 51, a set value storage area 52, and other storage area 53. The tape-type-table storage area 51 stores a table in which are defined characteristics of the printing medium installed on the printing apparatus 18. In the table, a width W, a type, etc., of the tape M are defined in association with a plurality of kinds of IDs, for instance. The width W is a width of the tape M as the printing medium, namely, a length of the tape M in a direction orthogonal to a longitudinal direction of the tape M. The type indicates a material and a structure of the tape M. Examples of the type include a laminate and a receptor. The "laminate" indicates a structure in which, after printing is performed on a resin-made transparent film tape, a double-sided adhesive tape (in which adhesive layers are formed on both surfaces of a base) is stuck to its print surface in the printing apparatus 18. The "laminate" includes a transparent laminate, for instance. The "transparent laminate" indicates a structure in which a double-sided adhesive tape (including a base) whose entire region is transparent is stuck to a film tape whose entire region is transparent, and the tape as a whole is transparent. In the following description, among the laminates, a laminate except the transparent laminate will be referred to as a "laminate" in a narrow sense. The "receptor" indicates a structure in which printing is performed on a resin-made single-sided adhesive tape (in which an adhesive layer is formed on only one surface of a base). The receptor includes a self laminate and a transparent receptor, for instance. As later explained with reference to FIG. 3A, the "self laminate" is formed of a label 20 and a film 30 which is contiguous to the label 20 in a widthwise direction W and which is a transparent portion having transparency for permitting visible light to transmit therethrough. (In both the label 20 and the film 30, an adhesive layer is formed on only one surface of a base.) The "self laminate" includes a transparent self laminate in which not only the film 30 but also the label 20 is transparent. In the following description, among the self laminates, a self laminate except the transparent self laminate will be referred to as a "self laminate" in a narrow sense. The "transparent receptor" is formed of a transparent film tape having transparency for permitting visible light to transmit therethrough. In the following description, among the receptors, a receptor except the self laminate, the transparent self laminate, and the transparent receptor will be referred to as a "receptor" in a narrow sense. In other words, the type of the printing medium in the present embodiment includes the "laminate", the "transparent laminate", the "receptor", the "self laminate", the "transparent self laminate", and the "transparent receptor" in a narrow sense. The set value storage area 52 stores set values used for the layout of the print object in the case where the tape M is wrapped around and stuck to an object T (an adherend) such as a cable. The set value storage area 52 will be later explained in detail. In other storage area 53, various sorts of calculation data are stored, for instance.

The printing apparatus 18 further includes a detecting portion 6, an operation portion 7, a display portion 8, and drive circuits 12-15. The detecting portion 6, the operation portion 7, and the drive circuits 12-15 are electrically connected to the CPU 1. The detecting portion 6 is a known sensor and configured to detect the type of the tape M installed on the printing apparatus 18 and output the detected type to the CPU 1. The operation portion 7 is used for inputting various instructions to the printing apparatus 18 (the CPU 1). The operation portion 7 is a touch panel, for instance. The display portion 8 is a liquid crystal display (LCD), for instance. The operation portion 7 may be constituted by switches, dials, and the like as long as the various instructions can be inputted. The drive circuit 12 is an electronic circuit for displaying characters and the like on the display portion 8. The drive circuit 13 is an electronic circuit for driving a tape conveying motor 9 (not shown) for conveying the tape M along a conveyance path. The drive circuit 14 is an electronic circuit for driving a thermal head 10. The drive circuit 15 is an electronic circuit for driving a cutter motor 11. The cutter motor 11 is for operating a movable blade (not shown) for cutting the printed tape M to be discharged outside the printing apparatus 18.

Figure 2A:
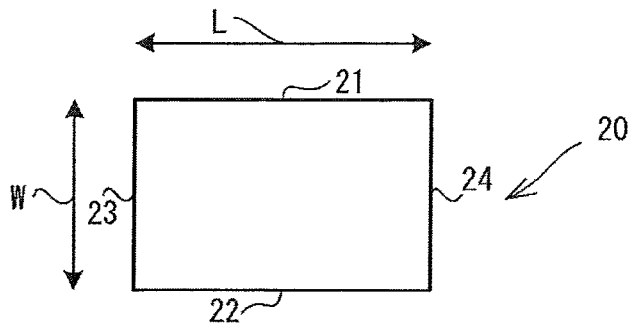
FIG. 2A is a view of a label.

Referring to FIG. 2, there will be explained a work for sticking a cut tape M to the adherend T in the case where the type of the tape M is any of the laminate, the transparent laminate, the receptor, and the transparent receptor. As illustrated in FIG. 2A, a label 20 obtained by cutting the tape M has a rectangular shape including four sides 21-24, in other words, four ends 21-24. The sides 23, 24 are short sides of the label 20 extending in a widthwise direction W of the tape M. The sides 21, 22 are long sides of the label 20 extending in a longitudinal direction L of the tape M. Length of the sides 21, 22 in the longitudinal direction L may be a predetermined value or may be variable depending upon a length of the print object in the longitudinal direction. A printing region is set on a print surface of the label 20.

Figure 2B:
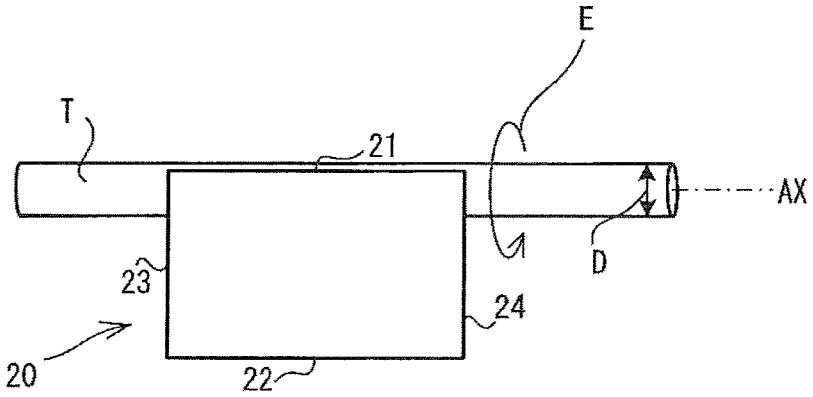
FIG. 2B is a view for explaining a method of sticking the label to an adherend in order from a first end to a second end of the label in a specific direction of the label.
Figure 2C:
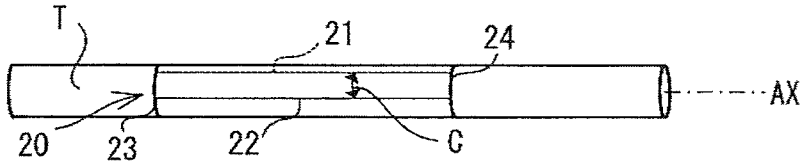
FIG. 2C is a view illustrating a state in which the label is stuck to the adherend in order from the first end to the second end of the label in the specific direction of the label.

As shown in FIG. 2B, in the case where the label 20 is wrapped around and stuck to the adherend T such as the cable, the user first peels off the release paper from the label 20 and then wraps the label 20 around the adherend T in a wrapping direction E from a first end 21 of the label 20 as a wrapping start portion. The first end 21 is one end of the label 20 in the widthwise direction W (as one example of a specific direction). Specifically, the user sticks the first end 21 of the label 20 to the adherend T with the side 21 disposed parallel to an axis AX of the adherend T, and an entirety of the label 20 is wrapped around an outer circumferential surface of the adherend T. As shown in FIG. 2C, in the case where the sides 23, 24 have a larger length in the widthwise direction W than a circumferential length of the adherend T, the side 22 of the label 20 is stuck not to the adherend T but to the label 20. That is, a portion of the label 20 including the side 21 is covered by a portion of the label 20 including the side 22. The wrapping start portion of the label 20 in the widthwise direction W may be the side 22. The specific direction of the label 20 may be the longitudinal direction L of the label 20. The first end 21 of the label 20 is one example of one end of the printing medium, and the second end 22 of the label 20 is one example of the other end of the printing medium.

Referring to FIG. 3, there will be next explained a work for sticking a printing medium 40 to the adherend T in the case where the type of the tape M is the self laminate or the transparent self laminate. As shown in FIG. 3A, the printing medium 40 obtained by cutting the tape M includes a label 20 and a film 30. The label 20 is similar to the label 20 in FIG. 2A. The film 30 is a transparent medium contiguous to the label 20 in the widthwise direction W and having transparency for permitting visible light to transmit therethrough. The film 30 has a rectangular shape having four sides 31-34. The sides 33, 34 are short sides of the film 30 extending in the widthwise direction W. The sides 31, 32 are long sides of the film 30 extending in the longitudinal direction L. The film 30 of the present embodiment is identical to the label 20 in size and shape and is connected, at the side 31 thereof, to the side 22 of the label 20. The label 20 and the film 30 do not necessarily have to be identical to each other in size and shape. Length of the sides 31, 32 in the longitudinal direction L may be a predetermined value or may be variable depending upon the length of the print object in the longitudinal direction L. The printing region is set on a print surface of the label 20 and is not set on the film 30.

Figure 3B:
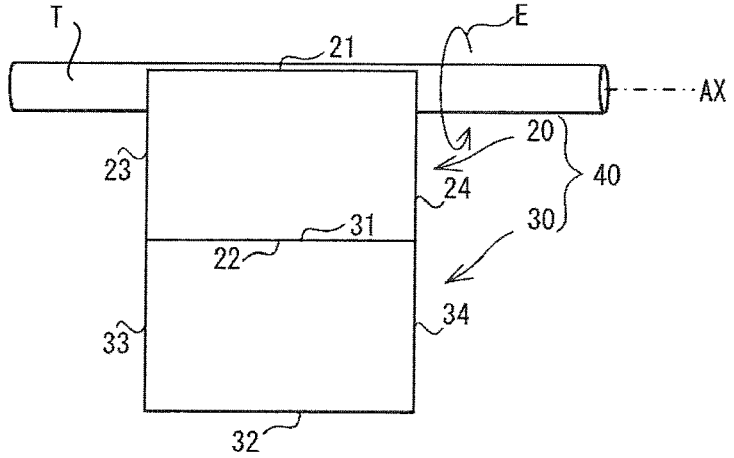
FIGS. 3B is a view for explaining a method of sticking the printing medium to the adherend in order from a first end to a second end of the printing medium in a specific direction of the printing medium.
Figure 3C:
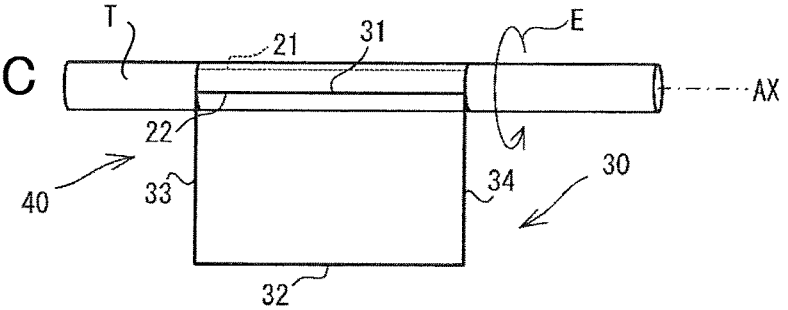
FIG. 3C is another view for explaining the method of sticking the printing medium to the adherend in order from the first end to the second end of the printing medium in the specific direction of the printing medium.
Figure 3D:
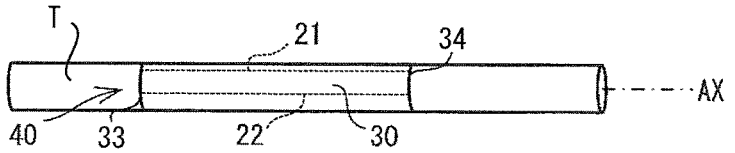
FIG. 3D is a view illustrating a state in which the printing medium is stuck to the adherend in order from the first end to the second end of the printing medium in the specific direction of the printing medium.

As shown in FIG. 3B, in the case where the printing medium 40 is wrapped around and stuck to the adherend T such as the cable, the user wraps the printing medium 40 around the adherend T in the wrapping direction E from the first end 21 of the label 20 as the wrapping start portion, the first end 21 being one end of the label 20 in the widthwise direction W. Specifically, the user sticks the first end 21 of the label 20 to the adherend T with the side 21 disposed parallel to the axis AX of the adherend T, and an entirety of the label 20 is stuck to the outer circumferential surface of the adherend T. As shown in FIG. 3C, in the case where a length of the sides 23, 24 in the widthwise direction W is larger than the circumferential length of the adherend T, the side 22 of the label 20 is stuck not to the adherend T but to the label 20. Further, the user wraps the film 30 over the label 20. As shown in FIG. 3D, in the case where the length of the sides 33, 34 in the widthwise direction W is larger than the circumferential length of the adherend T, the entirety of the label 20 is covered by the film 30. The first end 21 of the label 20 of the printing medium 40 is one example of one end of the printing medium, and the second end 22 of the label 20 of the printing medium 40 is one example of the other end of the printing medium.

The set value storage area 52 of FIG. 4 will be explained. As shown in FIG. 4, the set value storage area 52 stores a type of the tape M, a length of the printing region in the widthwise direction W, a length of a laminate region in the widthwise direction W, a diameter of the adherend, a circumferential length of the adherend, and an overlap amount in association with one another. In the present embodiment, an entirety of the print surface of the label 20 is the printing region for convenience sake. The printing region may be shifted inward, by a suitable margin length, from an outline of the print surface of the label 20. The margin length may be set by the user or may be a default value set in accordance with the type of the tape M. In the set value storage area 52, the length of the printing region is represented as a length of the tape M in the widthwise direction W. Both in the case where the type of the printing medium is any one of the laminate, the transparent laminate, the receptor, and the transparent receptor and in the case where the type of the printing medium is any one of the self laminate and the transparent self laminate, the length of the label 20 in the widthwise direction W is the length of the printing region in the widthwise direction W. The length of the laminate region in the widthwise direction W indicates the length of the film 30 in the widthwise direction W in the case where the type of the tape M is the self laminate or the transparent self laminate. The diameter of the adherend indicates a diameter of the adherend T having a cylindrical shape. The circumferential length of the adherend indicates a circumferential length of the adherend T corresponding to the diameter of the adherend. The overlap amount indicates a length C (FIG. 2) of an overlap portion in the wrapping direction E. The overlap portion is a portion of the printing medium which is covered by a portion of the printing medium including the second end 22 when the printing medium is stuck along the circumference of the adherend T in order from the first end 21 to the second end 22 (32) in the specific direction (the widthwise direction W) of the printing medium. In the case of the self laminate, the overlap portion is a portion of the printing medium which is covered by a portion of the printing medium including the second end 22 of the label 20 when the printing medium is stuck to the adherend T as described above. The items stored in the set value storage area 52 may be suitably changed. For instance, at least a part of or all of the diameter of the adherend, the circumferential length of the adherend, and the overlap amount do not have to be stored in the set value storage area 52 but may be calculated based on obtained values.

Referring next to FIGS. 5-9, a main process in the present embodiment will be explained taking, as an example, a case in which the print object is characters "AB". In the main process, there is executed a process of displaying, on the display portion 8, the print image that shows a stuck state of the label when the label is stuck to the adherend T such as the cable by being wrapped around the adherend T. In the main process of the present embodiment, a program stored in a program storage area of the ROM 2 for executing the main process is read out from the ROM 2 and written into the RAM 4 when a start instruction for creating the print image is obtained after the print object, a layout condition of the print object, and the diameter of the adherend T have been specified through the operation portion 7. The CPU 1 executes the following steps according to instructions included in the program read out from the ROM 2 and written into the RAM 4.

The start instruction includes the print object, the layout condition of the print object, and the diameter of the adherend T. The layout condition of the print object in the present embodiment is selected from among the following first through fifth conditions. The first condition is the same as a preceding layout condition stored in the flash memory 5. The second condition is a condition in which the length of the printing region in the widthwise direction W is set as the length of the print object in the widthwise direction W, so as to dispose the print object within the printing region. The third condition is a condition in which a length of a non-overlap portion in the widthwise direction W is set as the length of the print object in the widthwise direction W, so as to dispose the print object within the non-overlap portion. The non-overlap portion is a portion of the printing medium except the overlap portion. In the case of the self laminate, the non-overlap portion is a portion of the printing medium except the overlap portion within the label 20 as the printing region. The fourth condition is a condition in which a specific region in which the print object is disposed is set within the non-overlap portion and a length of the specific region in the widthwise direction W is set as the length of the print object in the widthwise direction W, so as to dispose the print object within the specific region. The specific region is a region corresponding to a quarter (¼) of the circumferential surface of the adherend T, for instance. The specific region may be a region selected or specified by the user or may be a region set by the CPU 1 in accordance with at least one of the adherend T and the print object. The fifth condition is a condition in which a size of a unit object (such as a font of letters) is assigned.

Figure 6:
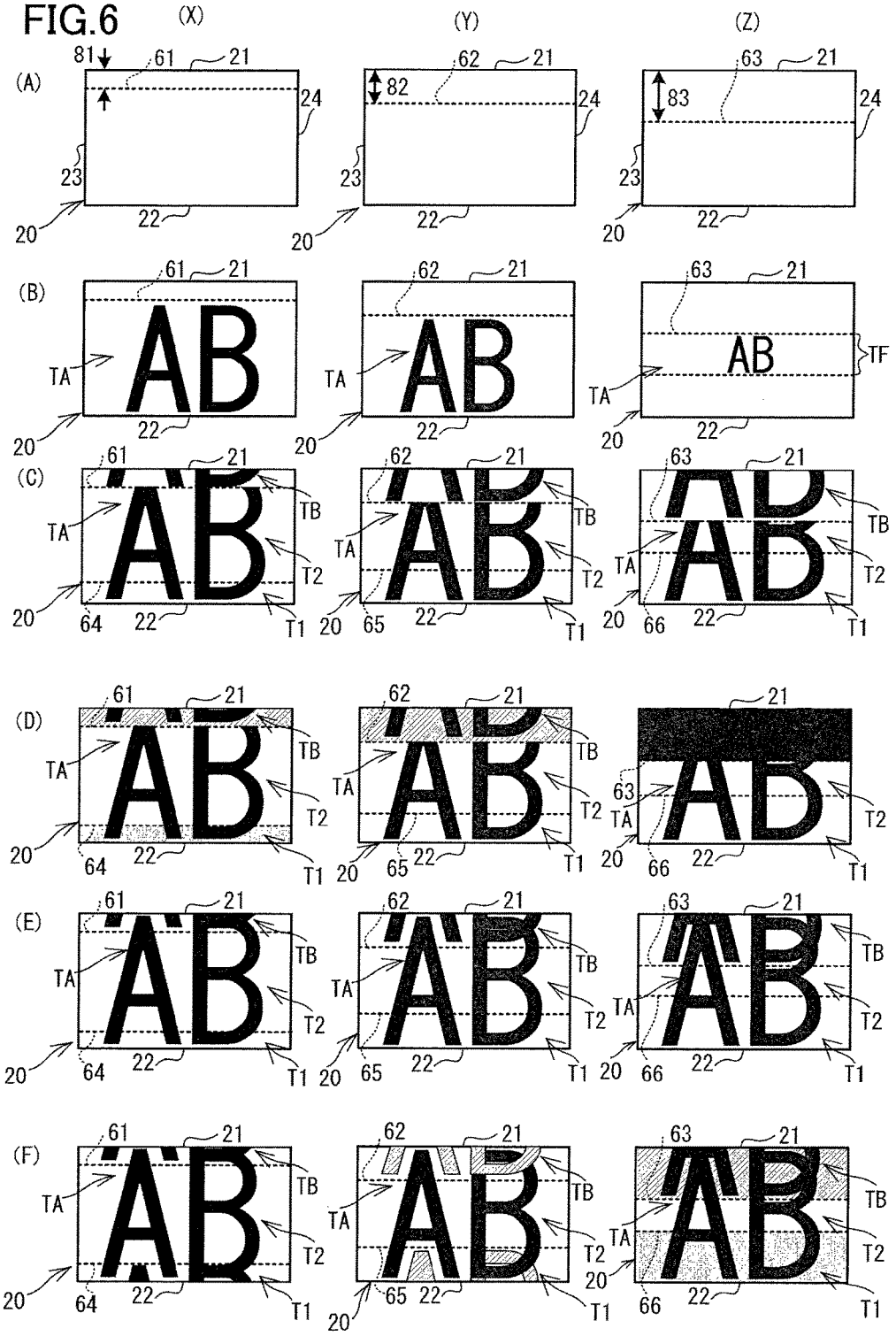
FIG. 6 is an explanatory view in a matrix form for explaining a procedure of setting, in the main process, a layout of a print object with respect to the label.

Parameters necessary for executing the main process are stored in the flash memory 5. Various sets of data obtained during execution of the main process are suitably stored in the RAM 4. Each of figures arranged in a matrix shown in FIG. 6 is represented as "Figure 6 (row symbol-column symbol)". The row symbol includes alphabetical letters A-F, and the column symbol includes alphabetical letters X-Z. For instance, "Fig. 6(A-Y)" indicates a figure of row A and column Y, namely, a figure in the first row and the second column.

Figure 5:
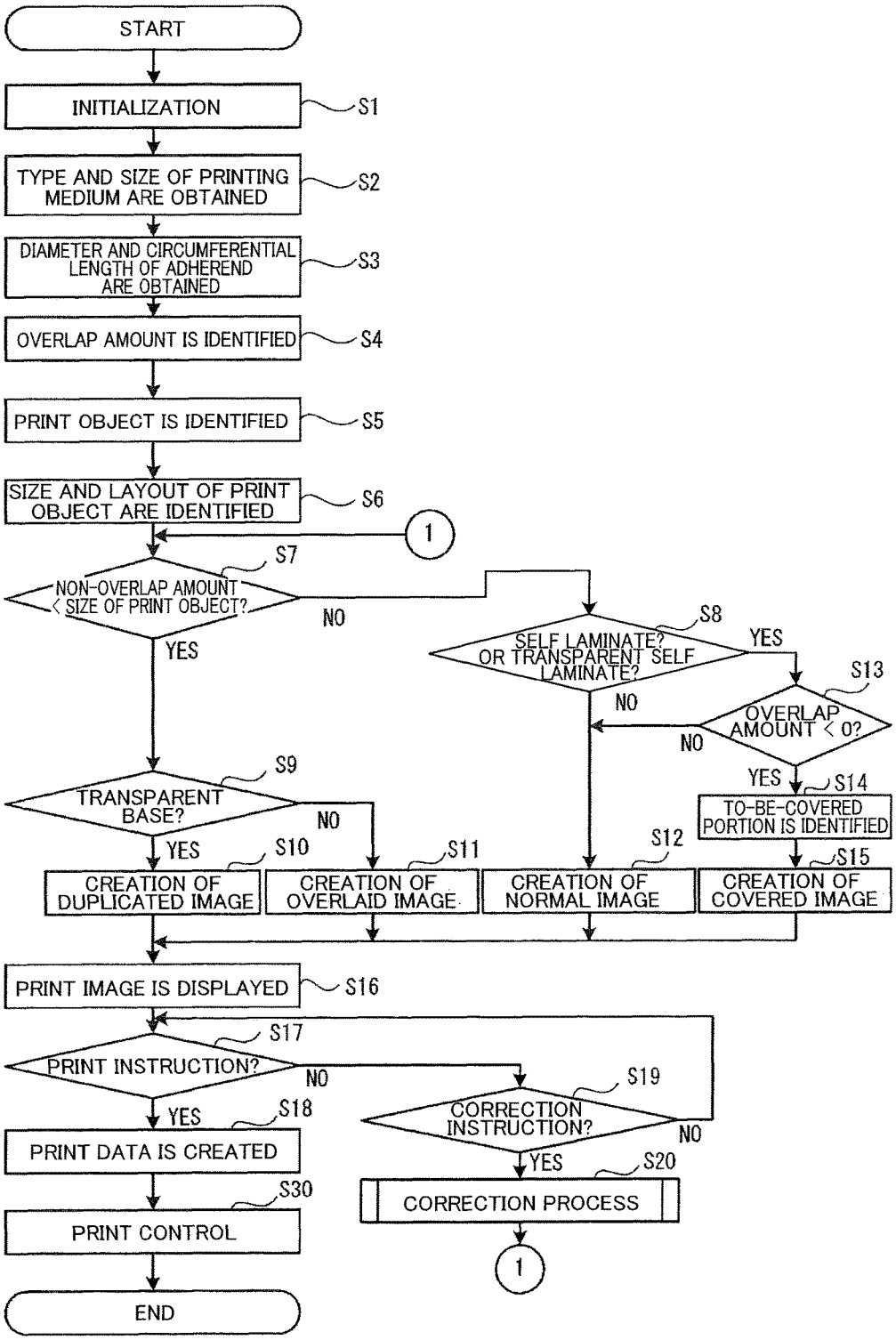
FIG. 5 is a flowchart illustrating a main process.

As shown in FIG. 5, the CPU 1 stores the obtained start instruction and initializes various set values (S1). The CPU 1 obtains the type of the printing medium and the size of the printing medium (S2). For instance, the CPU 1 obtains the type of the printing medium based on a signal input from the detecting portion 6. The CPU 1 may obtain the type of the printing medium based on information input by the user. The CPU 1 refers to the set value storage area 52 and obtains the length of the printing region in the widthwise direction Was the size of the printing medium corresponding to the type of the printing medium. The CPU 1 obtains the diameter and the circumferential length of the adherend T (S3). For instance, the CPU 1 obtains the diameter of the adherend T included in the start instruction. The CPU 1 refers to the set value storage area 52 and obtains the circumferential length of the adherend as the circumferential length corresponding to the diameter of the adherend T. The CPU 1 may calculate the circumferential length of the adherend based on the diameter of the adherend T included in the start instruction. The circumferential length of the adherend T may be a value obtained utilizing an RFID technique or the like or may be a value specified by the user. The circumferential length of the adherend may be a value that takes account of the thickness of the printing medium.

The CPU 1 identifies the overlap amount based on the type of the printing medium obtained at S2 and the diameter of the adherend T (S4). Specifically, the CPU 1 refers to the set value storage area 52 and identifies the overlap amount corresponding to the diameter of the adherend T obtained at S3. The overlap amount may be identified by calculation or may be a value specified by the user. The overlap amount may be a value that takes account of the thickness of the printing medium. A case in which the length of the printing region in the widthwise direction W is 25.4 mm is considered as one example In this case, an overlap amount 81 is 3.4 mm as shown in FIG. 6(A-X) when the diameter of the adherend is 7 mm. An overlap amount 82 is 6.6 mm as shown in FIG. 6(A-Y) when the diameter of the adherend is 6 mm. An overlap amount 83 is 9.7 mm as shown in FIG. 6(A-Z) when the diameter of the adherend is 5 mm. Each of dotted lines 61-63 represents a boundary between the overlap portion and the non-overlap portion.

The CPU 1 identifies the print object included in the start instruction (S5). Based on the start instruction, the CPU 1 identifies characters "AB" as the print object in the present embodiment. The CPU 1 identifies the size and the layout of the print object obtained at S5 (S6). The size of the print object identified at S6 is represented as the size of the print object in the widthwise direction W. In the present embodiment, one of the first through fifth conditions is selected as the layout condition, and the selected layout condition is included in the start instruction. The CPU 1 identifies the size and the layout of the print object in accordance with the condition included in the start instruction.

The CPU 1 determines whether a non-overlap amount is smaller than the size of the print object identified at S6 (S7). The non-overlap amount is a value obtained by subtracting the overlap amount identified at S5 from the length of the printing medium in the widthwise direction W.

When the layout condition is the second condition in the case where the overlap amount is any one of the overlap amount 81 shown in FIG. 6(A-X), the overlap amount 82 shown in FIG. 6(A-Y), and the overlap amount 83 shown in FIG. 6(A-Z), the CPU 1 determines that the non-overlap amount is smaller than the size of the print object (S7: YES). Thus, a part of the print object in the widthwise direction W is disposed in the overlap portion. Accordingly, the CPU 1 executes a process of displaying, on the display portion 8, the layout of the print object with respect to the printing medium such that the print object is distinguishable between: an overlap portion TB of the printing medium which is covered by the portion of the printing medium including the second end 22 when the printing medium is stuck along the circumference of the adherend T in order from the first end 21 to the second end 22 (32) of the printing medium in the specific direction; and a non-overlap portion TA of the printing medium except the overlap portion TB. (As explained above, in the case of the self laminate, the overlap portion TB of the printing medium is a portion of the printing medium which is covered by the portion of the printing medium including the second end 22 of the label 20 when the printing medium is stuck to the adherend T as described above, and the non-overlap portion TA is a portion of the printing medium except the overlap portion within the label 20 as the printing region.) The CPU 1 of the present embodiment displays, on the display portion 8, the layout of the print object with respect to the printing medium such that the overlap portion TB and the non-overlap portion TA are distinguishable from each other by causing at least one of a manner of displaying the print object and a manner of displaying a background of the print object to differ between the overlap portion TB and the non-overlap portion TA. Further, the CPU 1 of the present embodiment displays, on the display portion 8, the overlap portion TB and the non-overlap portion TA so as to be distinguishable from each other such that a manner of distinction between the overlap portion TB and the non-overlap portion TA is changed in accordance with the identified type of the printing medium.

Specifically, the CPU 1 determines whether the type of the printing medium obtained at S2 is classified into a transparent base (S9). The transparent base is a general term of the printing medium in which an entire region of a base has transparency for permitting visible light to transmit therethrough. Among the six types of the printing medium of the present embodiment, the type of the printing medium classified into the transparent base is the transparent laminate, the transparent self laminate, and the transparent receptor, and the type of the printing medium not classified into the transparent base is the laminate, the receptor, and the self laminate. When the CPU 1 determines that the type of the printing medium is not classified into the transparent base, namely, when the CPU 1 determines that none of the transparent laminate, the transparent self laminate, and the transparent receptor (S9: NO), the CPU 1 creates, as the print image, an overlaid image (S11). In the case where the type of the printing medium is none of the transparent laminate, the transparent self laminate, and the transparent receptor, the overlap portion TB is covered by the non-overlap portion TA when the label is stuck to the adherend T, so that the overlap portion TB is not seen from outside. The overlaid image is an image in which a part of the print object corresponding to the overlap portion TB is not displayed. In the case where the identified printing medium does not have transparency for transmitting visible light, the CPU 1 displays, in place of the part of the print object corresponding to the overlap portion TB, a part of the print object corresponding to a first portion T1 of the printing medium which is to cover a portion (i.e., the overlap portion TB) of the printing medium including the first end 21, so as to create the overlaid image in which the overlap portion TB and the non-overlap portion TA are distinguished from each other. When the layout condition is the second condition, the overlaid image is an image in which there is displayed, in the non-overlap portion TA, a normal image of a part of the print object corresponding to the non-overlap portion TA and there is displayed, in the overlap portion TB, the part of the print object corresponding to the first portion T1 of the printing medium which is to cover the portion (i.e., the overlap portion TB) of the printing medium including the first end 21, as shown in FIG. 6(C-X), FIG. 6(C-Y), and FIG. 6(C-Z). In the overlap portion TB, a normal image of the part of the print object corresponding to the overlap portion TB is not included. As shown in FIG. 6(D-X) and FIG. 6(D-Y), in the overlaid image, the background color may differ between the non-overlap portion TA and the overlap portion TB, for instance. As shown in FIG. 6(D-X), in the non-overlap portion TA, the first portion T1 which is to cover the overlap portion TB and a second portion T2 except the first portion T1 may be distinguished from each other. For instance, the first portion T1 and the second portion T2 may be distinguished by the color of the print object, the background color, etc. Each of dotted lines 64-66 indicates a boundary between the first portion T1 and the second portion T2. As shown in FIG. 6(D-Z), in the overlaid image, the overlap portion TB and the non-overlap portion TA may be distinguished by not displaying any part of the print object in the overlap portion TB. For instance, the overlaid image may be created by changing a manner of displaying the overlap portion TB and the second portion T2 after creation of a normal image (which will be described) of the print object.

When the CPU 1 determines that the type of the printing medium is classified into the transparent base (S9: YES), the CPU 1 creates a duplicated image as the print image (S10). In the case where the type of the printing medium is any one of the transparent laminate, the transparent self laminate, and the transparent receptor which are classified into the transparent base, the part of the print object corresponding to the overlap portion TB is visible from outside though covered by the non-overlap portion TA when the label is stuck to the adherend T. That is, the part of the print object corresponding to the overlap portion TB and the part of the print object corresponding to the first portion T1 that covers the overlap portion TB are seen in an overlapping state. The duplicated image is an image in which the part of the print object corresponding to the first portion T1 is superimposed on the part of the print object corresponding to the overlap portion TB. The CPU 1 superimposes, on the part of the print object corresponding to the overlap portion TB, the part of the print object corresponding to the first portion T1 of the printing medium which is to cover the portion (i.e., the overlap portion TB) of the printing medium including the first end 21, so as to create the duplicated image in which the overlap portion TB and the non-overlap portion TA are distinguished. When the layout condition is the second condition, the duplicated image is an image in which there is displayed, in the non-overlap portion TA, a normal image of the part of the print object corresponding to the non-overlap portion TA and, in the overlap portion TB, the part of the print object corresponding to the first portion T1 is superimposed on the part of the print object corresponding to the overlap portion TB, as shown in FIG. 6(E-X), FIG. 6(E-Y), and FIG. 6(E-Z). In the overlap portion TB, the normal image of the part of the print object corresponding to the overlap portion TB is included. As shown in FIG. 6(F-X) and FIG. 6(F-Y), in the duplicated image, the part of the print object corresponding to the overlap portion TB and the part of the print object corresponding to the first portion T1 may be superimposed on each other in each of the overlap portion TB and the first portion T1. As shown in FIG. 6(F-Y), the color of the print object may differ between the overlap portion TB and the first portion T1. As shown in FIG. 6(F-Z), in the duplicated image, the background color may differ between the overlap portion TB and the non-overlap portion TA. In the duplicated image, the background color may differ between the first portion T1 and the second portion T2. For instance, the CPU 1 may create the duplicated image by changing a manner of displaying the overlap portion TB and the second portion T2 after creation of the normal image (which will be described) of the print object.

Figure 7A:
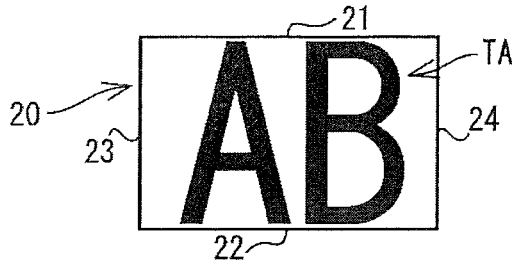
FIG. 7A is a view of a layout of the print object with respect to the label set in the main process.

When the layout condition is the third condition or the fourth condition, the non-overlap amount is not smaller than the size of the print object (S7: NO). In this instance, when the printing medium is stuck along the circumference of the adherend T in order from the first end 21 to the second end 22 (32) of the printing medium in the specific direction, an entirety of the printing region of the printing medium is the non-overlap portion. The CPU 1 determines whether the type of the printing medium identified at S2 is the self laminate including a transparent portion having transparency and a non-transparent portion not having transparency or the transparent self laminate (S8). When it is determined that the type of the printing medium is the self laminate or the transparent self laminate (S8: YES), the CPU1 determines whether the overlap amount identified at S4 is smaller than 0 (S13). When the overlap amount is not smaller than 0 (S13: NO), the CPU 1 creates a normal image as the print image (S12). Here, the normal image is an image in which only the print object is disposed in the printing region. For instance, the CPU 1 creates an image shown in FIG. 7A. In FIG. 7A, the manner of displaying the print object and the manner of displaying the background are respectively uniform over the entire region of the label 20.

When it is determined at S8 that the type of the printing medium is neither the self laminate nor the transparent self laminate (S8: NO), the CPU 1 creates the normal image (S12). When the non-overlap amount is not smaller than the size of the print object, an entirety of the print object is disposed within the non-overlap portion TA in the widthwise direction W. FIG. 6(B-X) and FIG. 6(B-Y) show a case in which the layout condition is the third condition. FIG. 6(B-Z) shows a case in which the layout condition is the fourth condition, namely, a case in which a half of the non-overlap portion TA in the widthwise direction W is set as a specific region TF. In all of FIG. 6(B-X), FIG. 6(B-Y), and FIG. 6(B-Z), no part of the print object is covered by the printing medium, in a strict sense, by the label 20 in the case of the self laminate, when the printing medium is stuck along the circumference of the adherend T in order from the first end 21 to the second end 22(32) of the printing medium in the specific direction.

In the case where the type of the printing medium is the self laminate and the overlap amount is smaller than 0 (S13: YES), a part of the label 20 is not covered by the film 30 when the printing medium 40 is stuck to the adherend T. The CPU 1 identifies a portion in the non-transparent portion covered by the transparent portion when the printing medium 40 is stuck to the adherend T, namely, identifies a portion in the label 20 to be covered by the film 30, i.e., a to-be-covered portion (S14). The CPU 1 identifies a length of the to-be-covered portion TD in the wrapping direction E. Specifically, the CPU 1 identifies the circumferential length of the adherend T based on the diameter of the adherend T obtained at S3. The CPU 1 subtracts the length of the label 20 in the wrapping direction E from the identified circumferential length of the adherend T so as to obtain a difference therebetween, and the length of the to-be-covered portion TD in the wrapping direction E is obtained based on the difference.

Figure 7B:
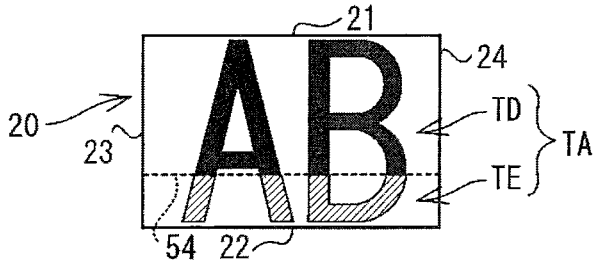
FIG. 7B is a view of a layout of the print object with respect to the label set in the main process.
Figure 7C:
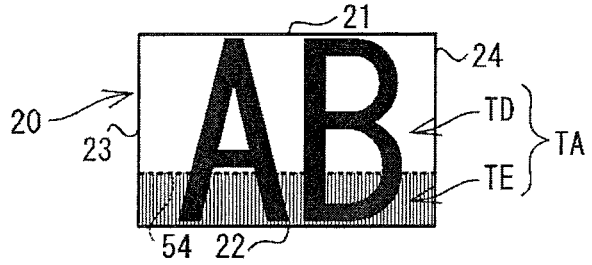
FIG. 7C is a view of a layout of the print object with respect to the label set in the main process.

The CPU 1 creates a covered image as the print image (S15). The CPU 1 sets a direction from the non-transparent portion toward the transparent portion as a direction from the first end 21 toward the second end 32 of the printing medium 40. The CPU 1 creates, as the covered image, an image in which the to-be-covered portion TD and the to-be-non-covered portion TE are distinguishable from each other when the printing medium 40 is stuck along the circumference of the adherend T in order from the first end 21 to the second end 32 of the printing medium 40. In the covered image, the to-be-covered portion TD and the to-be-non-covered portion TE are distinguishable from each other. As shown in FIG. 7B, in the covered image, the to-be-covered portion TD and the to-be-non-covered portion TE differ from each other in color, fill pattern, type of line, etc., of the print object. As shown in FIG. 7C, in the covered image, the to-be-covered portion TD and the to-be-non-covered portion TE differ from each other in color, a fill pattern (such as a type of hatching), etc., of the background of the print object. In each of FIGS. 7B and 7C, the dotted line 54 indicates a boundary between the to-be-covered portion TD and the to-be-non-covered portion TE.

Figure 8:
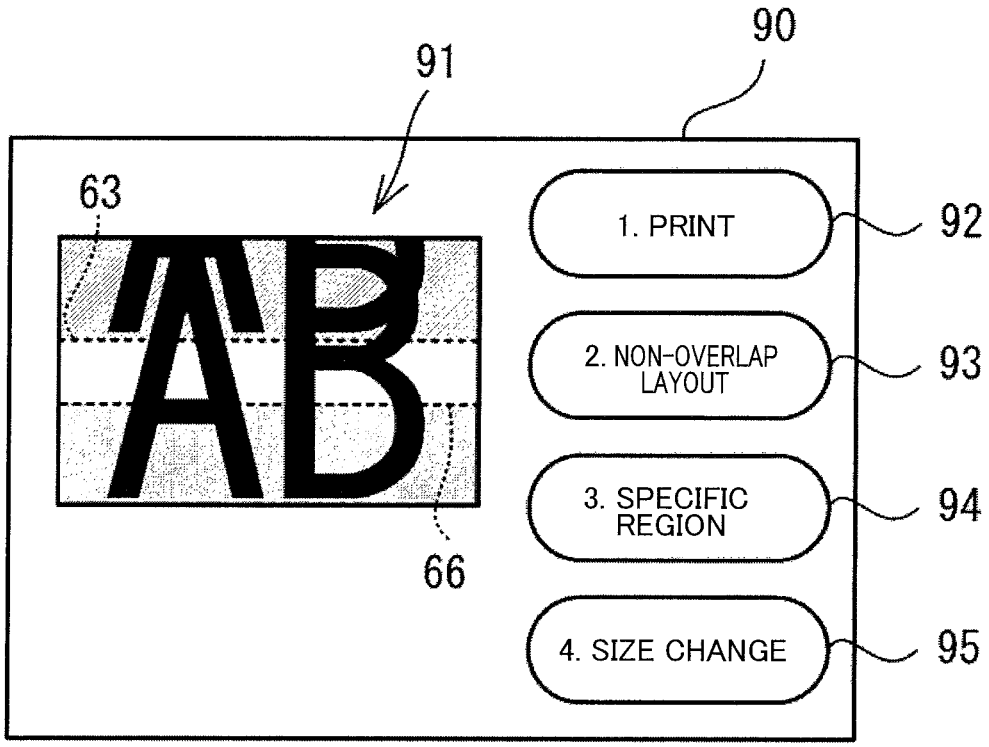
FIG. 8 is a view of a screen of a display of the printing apparatus.

After any one of S10, 511, S12, and S15, the CPU 1 controls the drive circuit 12 to display, on the display portion 8, the image created at a corresponding one of S10, 511, S12, and S15 (S16). When the image shown in FIG. 6(F-Z) is created at S10, for instance, the CPU 1 controls the drive circuit 12 to display, on the display portion 8, a screen 90 shown in FIG. 8. As shown in FIG. 8, a print image 91 and buttons 92-95 are displayed on the screen 90. In this case, the print image 91 to be displayed on the screen 90 is displayed based on the image in FIG. 6(F-Z). The button 92 is selected for performing printing under the condition indicated by the print image 91. The button 93 is selected for changing the layout condition from the condition indicated by the print image 91 to the third condition. The button 94 is selected for changing the layout condition from the condition indicated by the print image 91 to the fourth condition. The button 95 is selected for changing the layout condition from the condition indicated by the print image 91 to the fifth condition. In addition to the print image 91, the CPU 1 may display, on the display portion 8, a message notifying that the overlap portion will be produced under the current condition.

Figure 9:
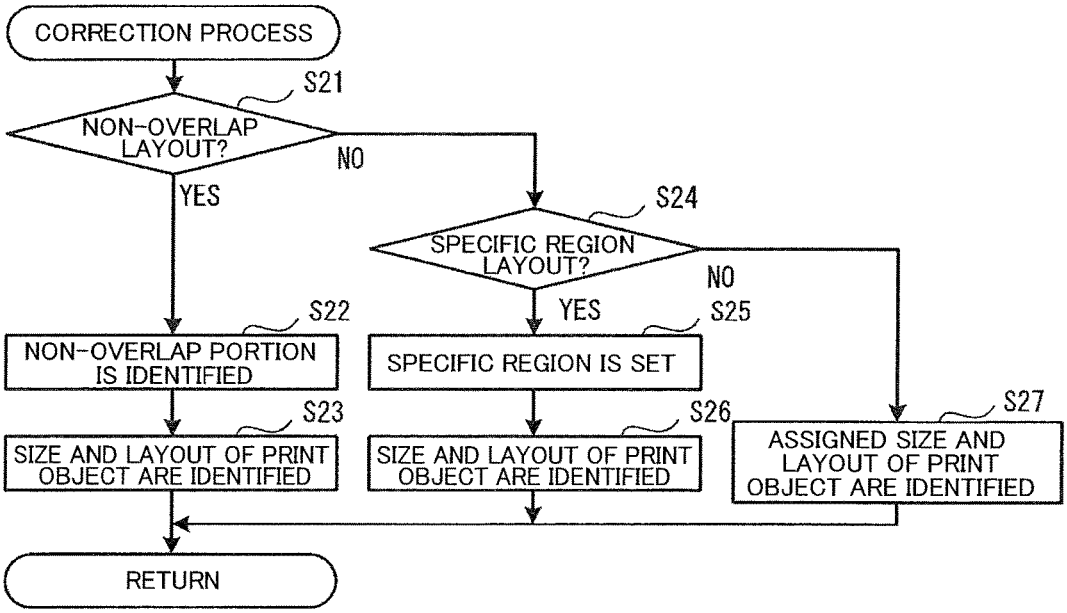
FIG. 9 is a flowchart illustrating a correction process executed in the main process of FIG. 5.

The CPU 1 determines whether the print instruction is obtained (S17). When it is detected that the button 92 has been selected, the CPU 1 determines that the print instruction is obtained. When the print instruction is not obtained (S17: NO), the CPU 1 determines whether a correction instruction is obtained (S19). When it is detected that any one of the buttons 93-95 has been selected, the CPU 1 determines that the correction instruction is obtained. When the correction instruction is obtained (S19: YES), the CPU 1 executes a correction process (S20). As shown in FIG. 9, when it is detected that the button 93 has been selected, the CPU 1 determines that the layout of the print object without any overlap has been selected (S21: YES). In this case, the CPU 1 identifies the non-overlap portion TA (S22). Further, the CPU 1 identifies the size of the print object in the widthwise direction W that allows the print object to be disposed within the non-overlap portion TA and identifies the layout of the print object (S23) as shown in FIG. 6(B-X) and FIG. 6(B-Y), for instance.

When it is detected that the button 94 has been selected, the CPU 1 determines that setting of the specific region has been selected (S21: NO, S24: YES). In this case, the CPU 1 identifies the specific region TF (S25) and adjusts the size of the print object such that the print object is disposed within the specific region TF (S26). As shown in FIG. 6(B-Z), for instance, the CPU 1 identifies the size of the print object in the widthwise direction W that allows the print object to be disposed within the specific region TF and identifies the layout of the print object (S26). When it is detected that the button 95 has been selected (S21: NO, S24: NO), the CPU 1 identifies the assigned size of the print object and identifies the layout of the print object (S27). After S23, S26, S27, the CPU 1 ends the correction process, and the control flow returns to the main process of FIG. 5. In the main process, the control flow returns to S7 after execution of the correction process (S20).

When the correction instruction is not obtained (S19: NO), the control flow returns to S17. When it is detected that the button 92 has been selected, the CPU 1 determines that the print instruction has been selected (S17: YES). In this case, the CPU 1 creates print data for printing, on the printing medium, the part of the print object corresponding to the non-overlap portion TA other than the part of the print object corresponding to the overlap portion TB (S18). In the case where the type of the printing medium is any one of the transparent laminate, the transparent self laminate, and the transparent receptor, the CPU 1 may create print data for printing, on the printing medium, both the part of the print object corresponding to the overlap portion TB and the part of the print object corresponding to the non-overlap portion TA. In consideration of an influence due to the thickness of the printing medium, for instance, the CPU 1 may shift the boundary between the overlap portion and the non-overlap portion toward the overlap portion and may create the print data for printing, on the printing medium, the part of the print object corresponding to the non-overlap portion TA except the shifted overlap portion TB. An amount of the shift may be automatically set in accordance with the type of the printing medium or may be specified by the user. The CPU 1 may display, on the display portion 8, a message notifying that the part of the print object corresponding to the overlap portion TB will not be printed under the current condition.

The CPU 1 controls the drive circuits 13-15 according to the print data created at S18 to print, on the tape M, the print image displayed at S16, and cut the tape M as needed (S30). In consideration of finished quality, printing of one line may be divided into plural printing operations performed plural times in accordance with a recording density (the number of dots per unit area) for one line. In such plural or divided printing, the CPU 1 may perform printing of one line at a time for lines at each of which the recording density is lower than a set threshold and may divide printing of one line into plural printing operations for lines at each of which the recording density is higher than the threshold (as described in Japanese Patent Application Publication No. 10-250130, for instance). Thus, the CPU 1 ends the main process.

In the embodiment illustrated above, the display portion 8 is one example of a display, the CPU 1 is one example of a controller, and the printing apparatus 18 is one example of an editing apparatus (printing apparatus). A portion of the CPU 1 that executes S2 functions as a means for obtaining the size of the printing medium. A portion of the CPU 1 that executes S5 functions as a means for obtaining the layout of the print object. A portion of the CPU 1 that executes S3 functions as a means for obtaining the circumference of the adherend. A portion of the CPU 1 that executes S10, S11, S12, S15, S16 functions as a means for executing a display control process. A portion of the CPU 1 that executes S2 functions as a means for identifying the type of the printing medium. A portion of the CPU 1 that executes S23, S26 functions as a means for adjusting the size of the print object. A portion of the CPU 1 that executes S25 functions as a means for setting the specific region. The tape conveying motor 9 is one example of a conveyor, and the thermal head 10 is one example of a printer. A portion of the CPU 1 that executes S18 functions as a means for creating the print data. A portion of the CPU 1 that executes S30 functions as a means for controlling printing.

According to the printing apparatus 18 constructed as described above, the overlap portion TB and the non-overlap portion TA are distinguishably displayed. In the case where the label 20 is wrapped around and stuck to the cable or the like, the user can confirm, before printing, that a part of the print object is disposed in the overlap portion. The printing apparatus 18 enables a reduction in a possibility of retrying the layout of the print object after printing, thus improving user convenience in laying out the print object on the label 20 that is used by being stuck to the adherend T such as the cable.

According to the printing apparatus 18 constructed as described above, the layout of the print object with respect to the printing medium is displayed on the display portion 8 such that the overlap portion TB and the non-overlap portion TA are distinguishable from each other by causing at least one of the manner of displaying the print object and the manner of displaying the background of the print object to differ between the overlap portion TB and the non-overlap portion TA. By causing the manner of displaying the print object and/or the manner of displaying the background of the print object to differ between the overlap portion TB and the non-overlap portion TA, it is possible to display the overlap portion TB and the non-overlap portion TA so as to be distinguishable from each other. In this configuration, the user easily recognizes the part of the print object corresponding to the overlap portion TB by referring to the display portion 8.

According to the printing apparatus 18 constructed as described above, the first portion T1 in the non-overlap portion TA which is to cover the overlap portion TB and the second portion T2 except the first portion T1 are distinguishably displayed on the display portion 8. In this configuration, the first portion T1 and the second portion T2 are distinguishably displayed, so that the user can recognize the first portion T1 which is to cover the overlap portion TB by referring to the display portion 8.

According to the printing apparatus 18 constructed as described above, the first portion T1 and the second portion T2 are distinguishably displayed on the display portion 8 by causing at least one of the manner of displaying the print object and the manner of displaying the background of the print object to differ between the first portion T1 and the second portion T2. By causing the manner of displaying the print object and/or the manner of displaying the background of the print object to differ between the first portion T1 and the second portion T2, it is possible to display the first portion T1 and the second portion T2 so as to be distinguishable from each other. In this configuration, the user easily recognizes the part of the print object corresponding to the first portion T1.

According to the printing apparatus 18 constructed as described above, the type of the printing medium is identified (S2), and the overlap portion TB and the non-overlap portion TA are distinguishably displayed on the display portion 8 such that a manner of distinction between the overlap portion TB and the non-overlap portion TA is changed depending upon the identified printing medium (S7-S16). In this configuration, the manner of distinction between the overlap portion TB and the non-overlap portion TA can be changed depending upon with the type of the printing medium.

In the case where the type of the identified printing medium is not classified into the transparent base, namely, in the case where the type of the identified printing medium is none of the transparent laminate, the transparent self laminate and the transparent receptor, but any one of the laminate, the receptor, and the self laminate (S9: NO), the part of the print object corresponding to the first portion T1 which is to cover the portion of the printing medium including the first end 21 is displayed in place of the part of the print object corresponding to the overlap portion TB, so that the overlap portion TB and the non-overlap portion TA are distinguishably displayed on the display portion 8 (S11, S16). Thus, in the case where the printing medium not having transparency in the entire region of the base is identified, the part of the print object corresponding to the first portion T1 is displayed in place of the part of the print object corresponding to the overlap portion TB. In other words, in the case where the printing medium not having transparency in the entire region of the base is identified, the printing apparatus 18 does not display the part of the print object which is disposed in the overlap portion TB and which is invisible when the printing medium is stuck along the circumference of the adherend T in order from the first end 21 to the second end 22 (32) of the printing medium in the specific direction. In this configuration, the user easily recognizes the part of the print object disposed in the overlap portion TB by referring to the display portion 8.

In the case where the identified printing medium has transparency in the entire region of the base, namely, in the case where the type of the printing medium is any one of the transparent laminate, the transparent self laminate, and the transparent receptor (S9: YES), the part of the print object corresponding to the first portion T1 which is to cover the portion of the printing medium including the first end 21 is overlaid on the part of the print object corresponding to the overlap portion TB, so that the overlap portion TB and the non-overlap portion TA are distinguishably displayed on the display portion 8 (S10, S16). Thus, in the case where the printing medium having transparency in the entire region of the base is identified, the part of the print object corresponding to the first portion T1 is overlaid on the part of the print object corresponding to the overlap portion TB. In other words, when the printing medium having transparency in the entire region of the base is identified, the printing apparatus 18 displays the overlap portion TB and the first portion T1 in an overlapping state in a case in which the printing medium is stuck along the circumference of the adherend T in order from the one end to the other end of the printing medium in the specific direction.

In the case where the identified printing medium is the printing medium (40) including the transparent portion having transparency and the non-transparent portion not having the transparency, namely, in the case where the identified printing medium is the self laminate, the direction from the label 20 as the non-transparent portion toward the film 30 as the transparent portion is set as the direction from the first end 21 toward the second end 32 of the printing medium 40. The printing apparatus 18 displays, on the display portion 8, the layout of the print object with respect to the printing medium (the label 20) such that the to-be-covered portion TD and the to-be-non-covered portion TE in a case in which the printing medium 40 is stuck along the circumference of the adherend T in order from the first end 21 to the second end 32 of the printing medium 40 are distinguishable from each other (S15, S16). In the case where the printing medium including the transparent portion and the non-transparent portion (the self laminate) is identified, the printing apparatus 18 distinguishably displays the to-be-covered portion TD and the to-be-non-covered portion TE on the display portion 8. Thus, the user can confirm the to-be-non-covered portion TE by referring to the display portion 8.

According to the printing apparatus 18 constructed as described above, the overlap portion TB and the non-overlap portion TA are identified in the non-transparent portion in the case where the type of the printing medium is the self laminate. In other words, the printing apparatus 18 does not identify the overlap portion TB and the non-overlap portion TA in the transparent portion. The printing apparatus 18 displays, in place of the part of the print object corresponding to the identified overlap portion TB, the part of the print object corresponding to the first portion T1 of the printing medium which is to cover the portion of the printing medium including the one end, so as to distinguishably display the overlap portion TB and the non-overlap portion TA on the display portion 8 (S11, S16). In this configuration, the part of the print object corresponding to the first portion T1 can be displayed in place of the part of the print object corresponding to the overlap portion TB even in the printing medium including the transparent portion and the non-transparent portion (the self laminate). Thus, the user easily recognizes the part of the print object disposed in the overlap portion TB by referring to the display portion 8.

The printing apparatus 18 constructed as described above adjusts the size of the print object such that the print object is disposed within the non-overlap portion TA and lays out the print object in the non-overlap portion TA (S23, S26). This configuration saves the user from having to adjust the size of the print object such that the print object is disposed within the non-overlap portion TA.

The printing apparatus 18 constructed as described above sets, within the non-overlap portion TA, the specific region TF in which the print object is disposed (S25). The printing apparatus 18 adjusts the size of the print object such that the print object is disposed within the specific region TF and lays out the print object within the specific region TF (S26). This configuration saves the user from having to adjust the size of the print object such that the print object is disposed within the specific region TF of the non-overlap portion TA.

According to the printing apparatus 18 constructed as described above, the part of the print object corresponding to the overlap portion TB is not printed. As compared with an arrangement in which the part of the print object corresponding to the overlap portion TB is printed, current consumption can be reduced. Especially, in the case where printing of one line is divided into plural printing operations in accordance with the recording density (the number of dots per unit area) for one line, the recording density can be made low, as compared with the arrangement in which the part of the print object corresponding to the overlap portion TB is printed, thus achieving high-speed printing.

It is to be understood that the editing apparatus, the non-transitory storage medium, and the printing apparatus according to the present disclosure are not limited to those described in the illustrated embodiment but may be modified and changed without departing from the scope of the disclosure. For instance, the following modifications may be suitably added or combined.

(A) The structure of the editing apparatus may be suitably changed. As long as the editing apparatus includes the display and the controller, the editing apparatus may be an apparatus not having the printing function, such as a personal computer (PC), a terminal device, and a dedicated device. In the case where the editing apparatus is the printing apparatus having the printing function, the printing apparatus is an apparatus capable of printing the print object on the printing medium. The printing apparatus need not necessarily include the cutter and the cutter motor. The printing medium is suitably selected depending upon the type of the printing apparatus. In addition to the tape-shaped printing medium, the printing medium may be paper, cloth, a heat shrinkable material, or a plastic sheet. The printing medium may be an adhesive tape without the release paper. The printing medium may be a die cut tape. Opposite ends of the side 22 of the label 20 need not necessarily coincide with opposite ends of the side 31 of the film 30. It is, however, desirable that the side 22 of the label 20 does not protrude beyond the opposite ends of the side 31 of the film 30. Each of the label 20 and the film 30 need not necessarily be rectangular as long as the entirety or a part of the label 20 can be covered. The label 20 and the film 30 may be trapezoidal or triangular, for instance. In the illustrated embodiment, the adherend to which the printing medium is attached or stuck is the outer circumferential surface of the cable. The adherend may be suitably changed. For instance, the curved surface to which the printing medium is stuck may be an inner circumferential surface of a cylinder, a circumferential surface of a polygonal prism that approximates to a circumferential surface of a cylindrical column, a curved surface of an imaginary cylinder, or a circumferential surface of a tubular member whose cross section is oval. The print object is not limited to characters but may be symbols, bar codes, figures, images, or a combination thereof. The printing medium may have a suitable margin.

(B) The program including instructions to cause the controller to execute the main process (FIG. 5) may be stored in a storage device of the editing apparatus at any timing as long as the program is stored before execution of the program by the controller. Accordingly, the program may be obtained by any method and through any route, and the device for storing the program may be changed. The program executed by the controller may be obtained from other device via a cable or wireless communication and may be stored in the storage device such as a flash memory. Examples of the other device include a personal computer (PC) and a server connected via a network, for instance.

(C) The steps in the main process (FIG. 5) of the editing apparatus executed by the CPU 1 may be partly or entirely executed by other electronic device (such as an ASIC). The controller may be configured otherwise. Execution of the steps in the main process may be shared by a plurality of electronic devices (such as a plurality of CPUs). The order of the steps in the main process may be changed as needed. One or more of the steps may be omitted, and other step may be added. The present disclosure includes a form in which an operating system (OS) or the like running on the editing apparatus executes a part of or an entirety of the main process based on instructions from the controller. The following changes (C-1)-(C-4) may be added to the main process, for instance.

(C-1) The method of identifying the print object may be suitably changed. The method of setting the specific region may be suitably changed. In the case where the adherend is a quadrangular prism, one of four surfaces of the quadrangular prism that is the non-overlap portion may be set as the specific region. In this case, the editing apparatus may obtain information indicating a position of the adherend to which the one end of the printing medium in the specific direction is to be stuck and may set the specific region based on the obtained information. In the case where the adherend has a cylindrical shape such as the cable, the editing apparatus may set, as the specific region, a region of the non-overlap portion in the wrapping direction corresponding to a specified amount such as an amount equivalent to one-third (⅓) of the circumference. A plurality of the specific regions may be set. In the case where the print object is constituted by characters arranged in a plurality of lines, the characters in the respective lines may be regarded as mutually different print objects, and the characters in the respective lines may be disposed in mutually different specific regions. The one end and the other end in the specific direction may be set according to a user's instruction or may be automatically set by the editing apparatus depending upon the type of the printing medium, the print object, and so on. In the case where the print object is constituted by a letter or letters, the editing apparatus may set an upper side of the letter or letters as the one end in the specific direction. Alternatively, the editing apparatus may set a top side in a direction in which letters are arranged as the one end in the specific direction.

(C-2) The method of obtaining the size and the type of the printing medium may be suitably changed. For instance, the size of the printing medium may be set such that the length of the printing medium in the widthwise direction is a value input by the user. Further, the widthwise direction and the longitudinal direction of the printing medium and the type of the printing medium may be specified by the user. The editing apparatus may be intended for a single type of the printing medium and may be configured not to change the manner of displaying between the overlap portion and the non-overlap portion in accordance with the type of the printing medium. The editing apparatus may be configured to distinguishably display the overlap portion and the non-overlap portion in one of a plurality of manners that is specified by the user. In the case where the printing medium includes the transparent portion and the non-transparent portion, the length in the widthwise direction may be the same or mutually different between the transparent portion and the non-transparent portion. In the case where the printing medium includes the transparent portion and the non-transparent portion, the to-be-covered portion and the to-be-non-covered portion need not necessarily be displayed so as to be distinguishable from each other.

(C-3) The editing apparatus may be configured not to have the function of laying out the print object in the non-overlap portion or the specific region. In the case where the editing apparatus has the function of laying out the print object in the non-overlap portion or the specific region, the editing apparatus may execute, at S6, the processes of S22, S23 or S25, S26 according to a user's instruction. The editing apparatus may suitably determine the layout of the print object in a direction intersecting the specific direction, e.g., the longitudinal direction, of the printing medium. For instance, the editing apparatus may obtain instructions such as centering, left justification, and right justification and may determine the layout of the print object in the intersecting direction based on the obtained instructions.

(C-4) The method of displaying the print image may be suitably changed. The print image may be an image that schematically or three-dimensionally indicates the printing medium in a state in which the printing medium is wrapped around and stuck to the adherend. For instance, only the portion of the printing medium including the one end can be seen in a state shown in FIG. 2C in which the printing medium is wrapped around and stuck to the adherend. In this respect, the editing apparatus may be configured to change a display area or a viewing point of the print image according to a user's instruction. The editing apparatus may be configured such that the layout condition is selectable or unelectable at the time of starting the printing. The kinds of the layout conditions which are selectable may be suitably changed. The printing apparatus may create print data for printing, on the printing medium, both of the part of the print object corresponding to the overlap portion and the part of the print object corresponding to the non-overlap portion irrespective of the type of the printing medium. The controller may create print data for printing the part of the print object corresponding to the non-overlap portion except the part of the print object corresponding to the overlap portion in response to reception of a user's instruction. At S16 in FIG. 5, a plurality of images created by a different method may be displayed at predetermined time intervals and in a predetermined order. For instance, at S16, the print mage 91 of FIG. 8 and the normal image may be alternately displayed.

What is claimed is:

1. An editing apparatus, comprising: a display; and a controller configured to control the display, wherein the controller is configured to:

obtain a size of a printing medium;

obtain a layout, with respect to the printing medium, of a print object to be printed on the printing medium;

obtain a length of a circumference of an adherend to which the printing medium is to be stuck; and execute a display control process of displaying, on the display, the layout of the print object with respect to the printing medium such that an overlap portion of the printing medium and a non-overlap portion of the printing medium are distinguishable from each other, the overlap portion being a portion of the printing medium which is covered, when the printing medium is stuck along the circumference of the adherend in order from one end to the other end of the printing medium in a specific direction thereof, by a portion of the printing medium including the other end, the non-overlap portion being a portion of the printing medium except the overlap portion.

2. The editing apparatus according to claim 1, wherein, in the display control process, the controller displays, on the display, the layout of the print object with respect to the printing medium such that the overlap portion and the non-overlap portion are distinguishable from each other by causing at least one of a manner of displaying the print object and a manner of displaying a background of the printing object to differ between the overlap portion and the non-overlap portion.

3. The editing apparatus according to claim 1, wherein, in the display control process, the controller displays, on the display, the layout of the print object with respect to the printing medium such that a first portion of the non-overlap portion which is to cover the overlap portion and a second portion of the non-overlap portion except the first portion are distinguishable from each other.

4. The editing apparatus according to claim 3, wherein, in the display control process, the controller displays, on the display, the layout of the print object with respect to the printing medium such that the first portion and the second portion are distinguishable from each other by causing at least one of a manner of displaying the print object and a manner of displaying a background of the print object to differ between the first portion and the second portion.

5. The editing apparatus according to claim 1, wherein the controller is configured to identify a type of the printing medium, and wherein, in the display control process, the controller displays, on the display, the layout of the print object with respect to the printing medium such that a manner of distinction between the overlap portion and the non-overlap portion is changed in accordance with the identified type of the printing medium.

6. The editing apparatus according to claim 5, wherein, in the display control process, the controller displays, on the display, the layout of the print object with respect to the printing medium such that the overlap portion and the non-overlap portion are distinguishable from each other by displaying, in place of a part of the print object corresponding to the overlap portion, a part of the print object corresponding to a portion of the printing medium which is to cover a portion of the printing medium including the one end, in a case where the printing medium whose type is identified does not have transparency.

7. The editing apparatus according to claim 5, wherein, in the display control process, the controller displays, on the display, the layout of the print object with respect to the printing medium such that the overlap portion and the non-overlap portion are distinguishable from each other by displaying a part of the print object corresponding to a portion of the printing medium which is to cover a portion of the printing medium including the one end so as to be overlaid on a part of the print object corresponding to the overlap portion, in a case where the printing medium whose type is identified has transparency.

8. The editing apparatus according to claim 5, wherein, in a case where the printing medium whose type is identified includes a transparent portion having transparency and a non-transparent portion not having transparency, a direction from the non-transparent portion toward the transparent portion is set as a direction from the one end toward the other end, and wherein, in the display control process, the controller displays, on the display, the layout of the print object with respect to the printing medium such that a to-be-covered portion of the non-transparent portion and a to-be-non-covered portion of the non-transparent portion are distinguishable from each other, the to-be-covered portion being a portion which is covered by the transparent portion when the printing medium is stuck along the circumference of the adherend in order from the one end to the other end, the to-be-non-covered portion being a portion which is not covered by the transparent portion.

9. The editing apparatus according to claim 8, wherein, in the display control process, the controller identifies the overlap portion and the non-overlap portion in the non-transparent portion and displays, on the display, the layout of the print object with respect to the printing medium such that the overlap portion and the non-overlap portion are distinguishable from each other by displaying, in place of a part of the print object corresponding to the overlap portion, a part of the print object corresponding to a portion of the printing medium which is to cover a portion of the printing medium including the one end.

10. The editing apparatus according to claim 1, wherein the controller is configured to adjust a size of the print object such that the print object is disposed within the non-overlap portion.

11. The editing apparatus according to claim 10, wherein the controller is configured to set, in the non-overlap portion, a specific region in which the print object is disposed, and wherein the controller is configured to adjust the size of the print object such that the print object is disposed within the specific region.

12. A non-transitory storage medium storing a program readable by the controller of the editing apparatus defined in claim 1, wherein the program, when executed by the controller, causes the controller to:

obtain a size of a printing medium;

obtain a layout, with respect to the printing medium, of a print object to be printed on the printing medium;

obtain a length of a circumference of an adherend to which the printing medium is to be stuck; and execute a display control process of displaying, on the display, the layout of the print object with respect to the printing medium such that an overlap portion of the printing medium and a non-overlap portion of the printing medium are distinguishable from each other, the overlap portion being a portion of the printing medium which is covered, when the printing medium is stuck along the circumference of the adherend in order from one end to the other end of the printing medium in a specific direction thereof, by a portion of the printing medium including the other end, the non-overlap portion being a portion of the printing medium except the overlap portion.

13. A printing apparatus, comprising:

a display:

a conveyor configured to convey a printing medium along a conveyance path;

a printer configured to perform printing on the printing medium conveyed by the conveyor; and a controller configured to control the display, the conveyor, and the printer, wherein the controller is configured to:

obtain a size of the printing medium;

obtain a layout, with respect to the printing medium, of a print object to be printed on the printing medium;

obtain a length of a circumference of an adherend to which the printing medium is to be stuck;

execute a display control process of displaying, on the display, the layout of the print object with respect to the printing medium such that an overlap portion of the printing medium and a non-overlap portion of the printing medium are distinguishable from each other, the overlap portion being a portion of the printing medium which is covered, when the printing medium is stuck along the circumference of the adherend in order from one end to the other end of the printing medium in a specific direction thereof, by a portion of the printing medium including the other end, the non-overlap portion being a portion of the printing medium except the overlap portion;

create print data for printing, on the printing medium, at least a part of the print object corresponding to the non-overlap portion; and cause the printer to perform printing on the printing medium based on the created print data.

* * * * *